United States Patent [19]

Goldsmith

[11] Patent Number: 4,754,817

[45] Date of Patent: Jul. 5, 1988

[54] SUBSEA WELL TEMPLATE FOR DIRECTIONAL DRILLING

[75] Inventor: Riley G. Goldsmith, Houston, Tex.

[73] Assignee: Conoco Inc., Ponca City, Okla.

[21] Appl. No.: 412,364

[22] Filed: Aug. 25, 1982

[51] Int. Cl.[4] ..... F21B 7/128

[52] U.S. Cl. ..... 175/7; 166/353; 166/366

[58] Field of Search ..... 175/7, 61, 8, 9, 10, 175/79, 80, 220; 166/266, 368, 362, 341, 342, 349, 352, 353; 405/195; 114/265

[56] References Cited

U.S. PATENT DOCUMENTS

| | | | |
|---|---|---|---|
| 3,142,343 | 7/1964 | Otteman et al. | 175/7 |
| 3,369,599 | 2/1968 | Evans | 166/352 |
| 3,603,386 | 9/1971 | Talley | 175/7 |
| 3,670,507 | 6/1972 | Mott et al. | 175/7 |
| 3,802,137 | 4/1974 | Armstrong | 173/151 |
| 3,949,693 | 4/1976 | Bauer et al. | 114/265 |
| 4,030,310 | 6/1977 | Schirtzinger | 61/86 |
| 4,053,022 | 11/1977 | Mercier | 175/5 |
| 4,068,729 | 1/1978 | Peerey | 175/8 |
| 4,174,011 | 11/1979 | Zaremba | 166/366 |
| 4,212,562 | 7/1980 | Stone et al. | 175/7 |

*Primary Examiner*—Stephen J. Novosad
*Assistant Examiner*—David J. Bagnell
*Attorney, Agent, or Firm*—Richard K. Thomson

[57] ABSTRACT

A subsea drilling template has a plurality of drilling guides disposed at various angles relative to the plane of the template. The drilling guides cause angular deviation of the drill string passing into the guides resulting in wide spacing of the boreholes drilling through the template. The widespread boreholes allow efficient production of shallow subsea hydrocarbon producing formation without the need of satellite wells.

1 Claim, 1 Drawing Sheet

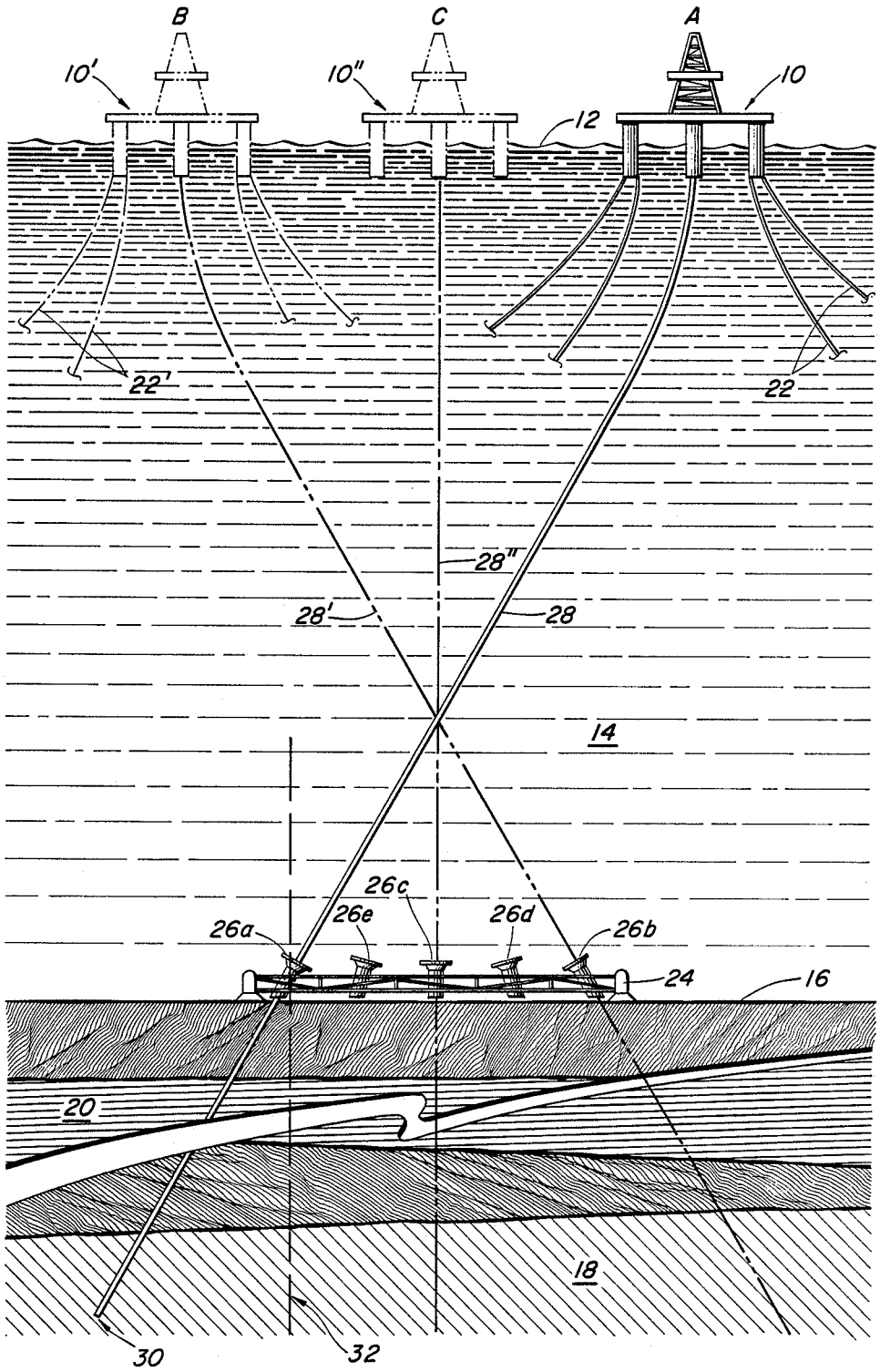
B
C
A
10'
10"
10
12
22'
22
28"
28'
28
14
26c
26e
26d
26a
26b
24
16
20
18
30
32

SUBSEA WELL TEMPLATE FOR DIRECTIONAL DRILLING

This invenion related to the art of well drilling for the production of hydrocarbons from subsea formations and more particularly to a drilling template for such drilling.

BACKGROUND OF THE INVENTION

The following shall constitute a prior art statement in compliance with the guidelines as set forth in 37 CFR Sections 1.56, 1.97 and 1.98.

In producing hydrocarbons from subsea formations, it has become common practice to utilize a drilling template located on the sea floor. Such drilling templates are relatively massive structures incorporating a number of drilling guide tubes disposed in an array within the structure of the template. Patents describing templates of this general nature include U. S. Pat. Nos. 4,174,011, 4,212,562 as well as many others.

Such templates are generally located on the sea floor by attaching them to driven pilings or other anchoring means which have been previously located on the sea floor. A template position is then adjusted to a perfectly horizontal plane so that the vertically disposed drilling guide tubes are as nearly exactly perpendicular to the earth's surface as possible. The drilling of the wells then proceeds from the sea surface from a fixed platform, moored floating platform or a drilling ship located, to as near an extent possible, at a position directly vertically above the drilling guide tubes in the subsea template.

In this manner, a number of production wells are drilled into the hydrocarbon producing formation located below the sea floor. In the drilling of such production wells, it is common to begin drilling a vertical 36 inch diameter hole to a depth of 100 to 300 feet and cementing in a 30 inch conductor within this hole. This is followed by drilling a 26 inch diameter vertical hole below the 30 inch conductor to a depth of 1000 to 1500 feet and cementing in a second conductor of 20 inches in diameter. From the bottom of this conductor, now located at much as 2000 feet below the sea floor, the drilling head is deviated from the vertical so as to penetrate a productive formation at a distance from an adjacent borehole which is greater than the distance separating the drilling guide tubes at the template. Thus, more efficient production of the hydrocarbon fluids from the producing formation is achieved by spreading the producing wells as far apart from each other as is possible.

Wide spacing of the boreholes in a shallow (3000 to 6000 feet) producing formation so that the hydrocarbons may be efficiently produced presents a problem with the use of such templates. If angular deviation from the vertical does not begin until a point which is 1500 to 2000 feet toward such a shallow producing formation, little angular deviation can be achieved in the remaining distance to the shallow producing formation. It then becomes necessary to drill satellite wells with their attendent complications and expense in order to efficiently produce hydrocarbons from a shallow formation.

SUMMARY OF THE INVENTION

The present invention provides a means and method for achieving widely spaced borehole intrusions into a subsea hydrocarbon producing formation, particularly shallow formations, in order to effect efficient production of such formations without the need for satellite well drilling and connection.

In accordance with the invention, a system for drilling widely spaced boreholes in a hydrocarbon producing subsea formation comprises a drilling vessel floating on the surface of a body of water having a bottom. Mooring means locate the drilling vessel in a position on the surface of the body of water relative to a drilling template located on the sea floor. The drilling template includes a plurality of substantially cylindrical drilling guides which are laterally disposed relative to each other on a horizontal plane passing through the subsea template. Each of the drilling guides has a central, longitudinal axis which is disposed at an angle which is less than or equal to 90° relative to the horizontal plane of the template. Drilling means extend from the floating vessel through the body of water to the subsea template, the drilling means being guided through one of the drilling guides along its longitudinal axis.

Further in accordance with the invention, a method of drilling a plurality of widely spaced boreholes into a hydrocarbon producing subsea formation utilizing the aforedescribed apparatus comprises positioning the drilling vessel in a plurality of positions relative to the afore-described drilling template by adjusting the mooring means of the drilling vessel. The drilling means extends from the drilling vessel in each of the plurality of positions to one of the plurality of drilling guides disposed in the subsea template. Boreholes are then drilled through the subsea template at each of the drilling guides to the hydrocarbon producing subsea formation.

Further in accordance with the invention, a subsea drilling template comprises a plurality of substantially cylindrical drilling guides spaced laterally from each other along a horizontal plane passing through the template. Each of the drilling guides has a longitudinal axis passing through the center thereof and at least some of the plurality of drilling guides have their longitudinal axes disposed at an angle less than 90° relative to the horizontal plane passing through the subsea template.

It is therefore an object of this invention to provide an apparatus and method for drilling widely spaced boreholes into a producing subsea formation from a single subsea drilling template.

It is another object of this invention to provide an apparatus and method for producing hydrocarbons from relatively shallow subsea formations without the need of satellite wells disposed at a distance from a central position in the drilling field.

BRIEF DESCRIPTION OF THE DRAWING

These and other objects of the invention are accomplished through the manner and form of the present invention to be described hereinafter in conjunction with the accompanying drawing forming a part of this specification and in which the single FIGURE illustrates schematically the drilling apparatus and method employed in a preferred embodiment of this invention.

DETAILED DESCRIPTION OF THE PREFERRED EMBODIMENT AND DRAWING

Referring now to the drawing wherein the showing is for the purpose of illustrating a preferred embodiment of the invention only and not for the purpose of limiting same, the FIGURE shows a drilling vessel 10 such as a drill ship or, as illustrated, a semi-submersible drilling rig. The drilling vessel 10 is floating on the surface 12 of a body of water 14 having a bottom 16. A subsea hydrocarbon producing formation 18 is located below a number of intermediate subsea strata 20 forming the bottom 16 of the body of water 14.

The drilling vessel 10 is moored in a first position A by a plurality of mooring catenaries 22 extending generally radially outwardly from the drilling vessel 10. Although not shown in the FIGURE, the mooring catenaries 22 temrinate at anchoring means located on the water bottom 16. As will be seen as this description proceeds, it is preferred that the anchoring means for the mooring catenaries 22 be of the temporary, retrievable type rather than the fixed, permanent type. As shown in the FIGURE, the drilling vessel 10 positioned in the water by mooring catenaries 22 is in a position A on the surface 12 of the body of water 14.

A drilling template 24 is fixed in position on the seabottom 16. A plurality of well drilling guides **26*a* through 26*e* are shown in the FIGURE mounted at various angles in the drilling template 24. It will be understood that the illustration of the template 24 and its associated well drilling guides 26*a* through 26*e* is greatly simplified for the purposes of clarity. The template may also include valving, piping and other such equipment well known and in use on drilling templates such as for well completion, production and the like. The template 24 is fixed to the bottom 16** by any manner which is also common in the art.

While precise horizontal positioning of the drilling template 24 is preferable, such positioning is not critical to the degree necessary in using prior known drilling templates. It can be seen that since the longitudinal axes of the drilling guides tubes **26*a* through 26*e* are desirably deviated from the vertical, exact positioning of the template 24 is less critical. Only the angle to which the drill string must be positioned to properly enter the drilling guides 26*a*–26*e*** must be determined.

As seen in the FIGURE, a drilling riser 28 extends from the drilling vessel 10 to one of the cylindrical drilling guides **26*a* in the subsea template 24. Because of the angular deviation from the vertical of the longitudinal axis of the drilling guide 26*a*, the drill string 28 passes into and through the subsea strata 20 and into the subsea producing formation 18 at an angle so that when the hole is bottomed out at the position indicated by the numeral 30 in the subsea producing formation 18, such hole is widely deviated from a position 32 which would be the bottom of a hole drilled through a drilling guide having a vertical longitudinal axis on the subsea template 24 located in the position of the angularly deviated drilling guide 26*a*. While the FIGURE shows the drilling of a borehole in a straight line from the drilling guide tube 26*a* to the bottom of the borehole 30, it will be understood that the borehole is commonly and desirably deviated even further toward the horizontal as it descends to the hydrocarbon producing formation 18. Thus, with even greater angle being built in the descent of the well bore, the borehole bottom 30 would be located at an even greater distance from the aforementioned straight-down position 32**.

The FIGURE also illustrates a decreasing angle of incidence of the longitudinal axis of each of the drilling guides **26*a*–26*e* relative to a horizontal plane passing through the subsea template 24 as the outer edges of the subsea template 24 are approached. Thus, the central drilling guide 26*c* is disposed substantially vertically on the template 24 so that its angle of incidence with a horizontal plane passing through the template 24 is approximately 90°. The next drilling guides 26*e*, 26*d* which are disposed laterally outwardly of the central drilling guide 26*c* are at a somewhat lesse angle of incidence relative to the plane of the template 24 while the outermost drilling guides 26*a*, 26*b* which are even further laterally disposed outwardly from the other drilling guides 26*c* through 26*e* are at an even lesser angle of incidence relative to a horizontal plane passing through the subsea template 24. it should be apparent that while the FIGURE illustrates the template 24 and the drilling guides 26*a*–26*e* in two-dimensional form, a three-dimensional template with several rows of drilling guides 26 is common. Thus, it will be understood that those drilling guides 26 which are located centrally in a three dimensional template 24 are substantially vertically disposed while other drilling guides disposed laterally outwardly of such central drilling guides 26 preferably have their longitudinal axis disposed at decreasing angles of incidence relative to similar drilling guide positioned laterally inwardly toward the central portion of the template 24. Also, while templates of generally rectangular form are common, it can be clearly seen that other geometric forms such as circular would be possible for a subsea template 24 with the drilling guides 26 having decreasing angles of incidence to the horizontal in positions radially outwardly from the center of the template 24**. It will be further understood that while a decrease in the angle of incidence outwardly of the central portion of the template is preferred, other arrangements may be desirable and possible within the scope of this invention.

The method of drilling widely spaced boreholes through the subsea template 24 is also illustrated in the FIGURE. Once the drill string 28 has reached the desired position in the subsea producing formation 18 by drilling through the drilling guide **26*a* in the subsea template 24, the well may be capped off or completed as is common in the art. The drill string 28 is withdrawn and the drilling vessel 10 is then moved to a second position B and maintained in that position B by positioning means such as mooring catenaries 22'. A drill string 28' is then extended from the drilling vessel 10' in its new position B to a second drilling guide 26*b* in the drilling template 23. Drilling then proceeds again in the manner previously described including the use of the preferred, known directional drilling techniques to build greater angle into the borehole until the drill string 28' reaches the desired position in the subsea producing formation 18. As with the previous borehole, the drill string is then withdrawn and the borehole capped and/or completed as desired and the drilling vessel 10'' is then repositioned in yet another position C relative to the subsea template 24. The drill string 28'' then extends from the drilling vessel 10'' in the position C to the subsea template and drilling guide 26*c* where the drilling proceeds as previously described. This process is repeated with the repositioning of the drilling vessel for the drilling of each of the boreholes through the drilling guides 26*a*–26*e*** until all of the desired wells have been drilled.

While mooring lines 22 have been shown as the positioning means for the drilling vessel 10, it will be understood that other positioning means such as dynamic positioning by propeller means is also possible and contemplated within the scope of the invention. Further, it may or may not be necessary to reposition the anchors for the mooring catenaries 22 every time the drilling vessel 10 is repositioned to drill a new well. It may be possible to effect proper positioning of the drilling vessel 10 by slacking some of the mooring catenaries 22 while tightening others.

While the invention has been described in the more limited aspects of the preferred embodiment thereof, other embodiments have been suggested and still others will occur to those skilled in the art upon the reading and the understanding of the foregoing specification. It is intended that all such embodiments be included within the scope of this invention as limited only by the appended claims.

Having thus described my invention, I claim:

1. A method for drilling widely spaced boreholes into a hydrocarbon producing subsea formation comprising the steps of:

positioning a subsea drilling template on the bottom of a body of water, the subsea drilling template including a plurality of laterally disposed, substantially cylindrical drilling guides, each of said substantially cylindrical drilling guides having a longitudinal axis wherein at least one of said plurality of drilling guides has its longitudinal axis disposed at an angle of less than 90° relative to a horizontal plane passing through said subsea drilling template;

mooring a drilling vessel floating on the surface of the body of water in a first position relative to the subsea drilling template using a plurality of mooring catenaries;

extending a drill string from said floating vessel to said subsea template, said drill string passing into said one of said plurality of drilling guides along its longitudinal axis which is disposed at an angle of less than 90°;

drilling a borehole below said template into the hydrocarbon producing subsea formation;

repositioning said drilling vessel to another position relative to said subsea template by adjusting the plurality of mooring catenaries;

extending said drill string from said vessel into another of said drilling guides;

drilling another borehole below said template;

and repeating said steps of repositioning said drilling vessel, extending said drill string and drilling said plurality of widely spaced boreholes.

* * * * *